United States Patent [19]

Nolan

[11] Patent Number: 4,476,987

[45] Date of Patent: Oct. 16, 1984

[54] BOTTLE CAPS

[75] Inventor: Robert L. Nolan, Astoria, N.Y.

[73] Assignee: Maxcap, Inc., New York, N.Y.

[21] Appl. No.: 370,041

[22] Filed: Apr. 20, 1982

[51] Int. Cl.[3] ..... B65D 41/16

[52] U.S. Cl. ..... 215/319; 215/270; 215/316; 215/329; 411/307; 411/412

[58] Field of Search ..... 215/246, 252, 260, 270, 215/311, 319, 316, 329; 411/263, 307, 412, 413

[56] References Cited

U.S. PATENT DOCUMENTS

| | | | |
|---|---|---|---|
| 2,485,280 | 10/1949 | Grace | 411/413 |
| 2,877,918 | 3/1959 | Gardner | 215/311 |
| 3,556,335 | 1/1971 | Snyder | 215/270 |
| 3,589,545 | 6/1971 | Carpenter, Jr. | 215/260 |
| 3,687,183 | 8/1972 | Rohm | 411/307 |
| 4,018,132 | 4/1977 | Abe | 411/413 |
| 4,206,851 | 6/1980 | Ostrowsky | 215/246 |
| 4,266,590 | 5/1981 | McKewan | 411/307 |
| 4,294,370 | 10/1981 | Teoppen | 215/329 |
| 4,354,609 | 10/1982 | Hidding | 215/329 |

OTHER PUBLICATIONS

Modern Plastics, Apr. 1977, p. 49.

Food & Drug Packaging, Apr. 1982, pp. 1 (portion), 14, 24, 44, 45, (with full scale photographs for pp. 24, 44, 45).

*Primary Examiner*—Joseph Man-Fu Moy

*Assistant Examiner*—David Fidei

*Attorney, Agent, or Firm*—Abner Sheffer

[57] ABSTRACT

A plastic cap for glass or plastic carbonated beverage bottles is shaped so that in use pressure is exerted around the edges of a gasket to give enhanced sealing. A single cap can fit the different necks of standard glass and plastic bottles. Its heat-shrinkable skirt has longer portions between connectors.

8 Claims, 12 Drawing Figures

Figure 4:
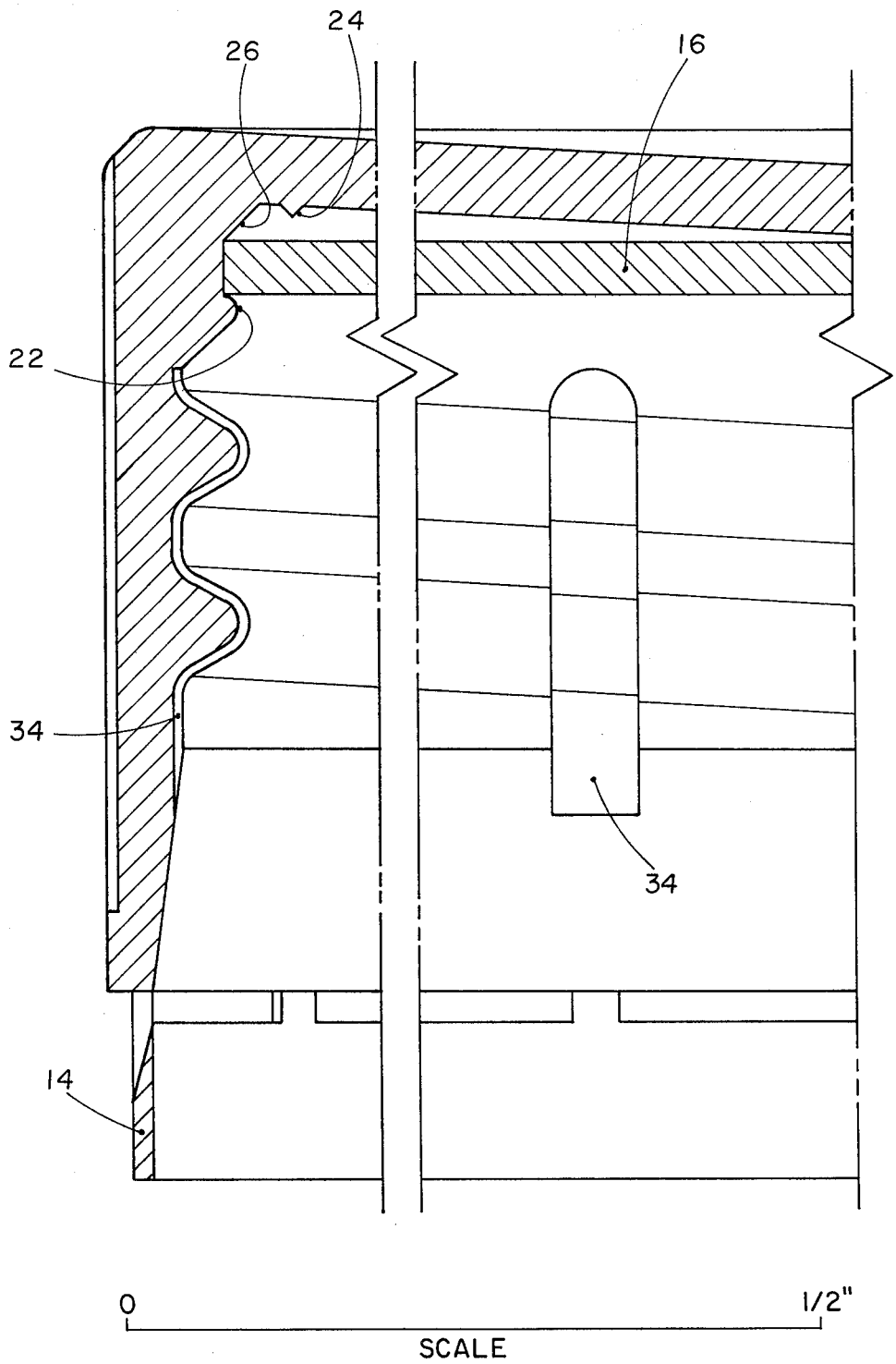

FIG. 1
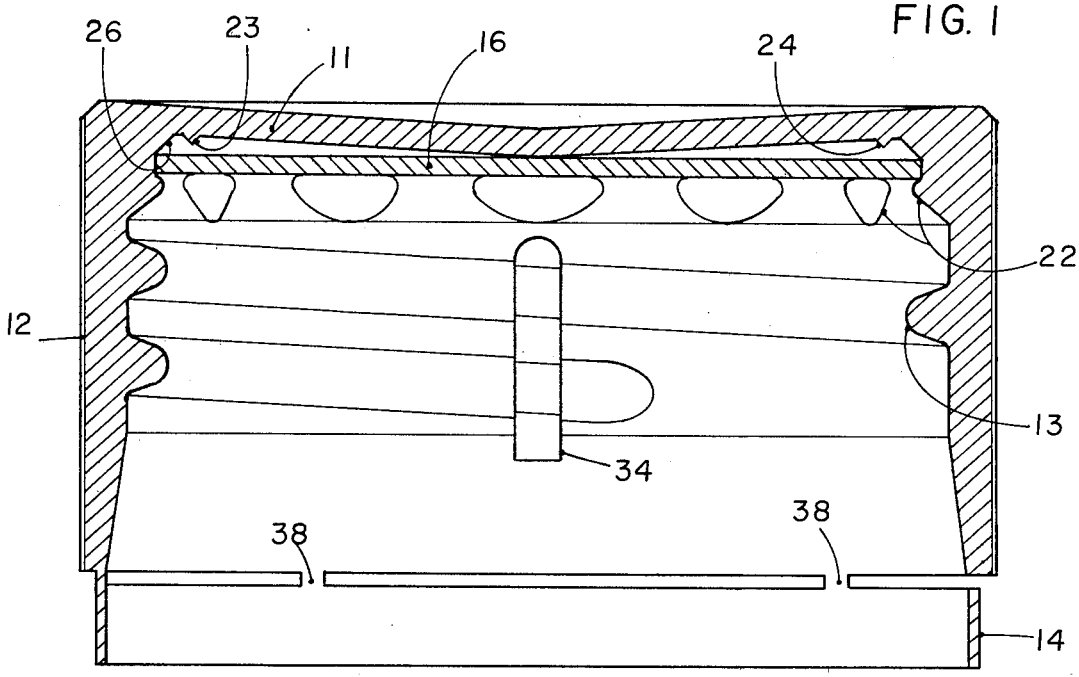
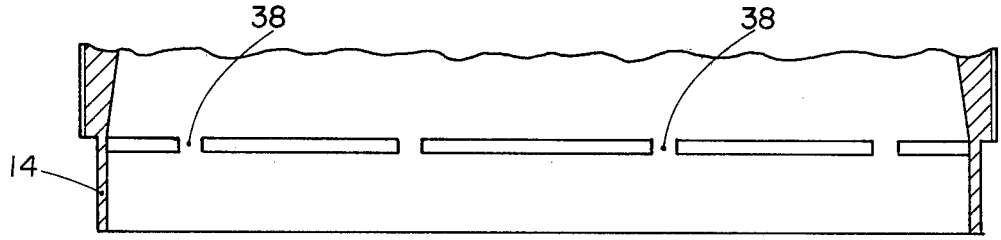
FIG. 9
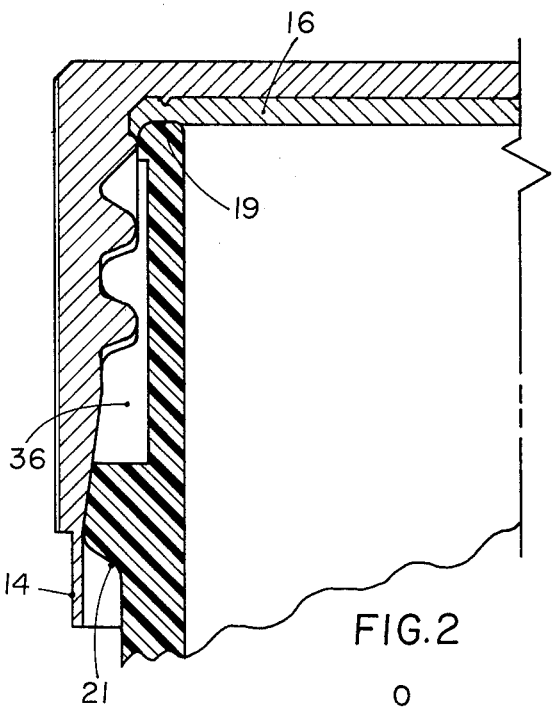
FIG. 2
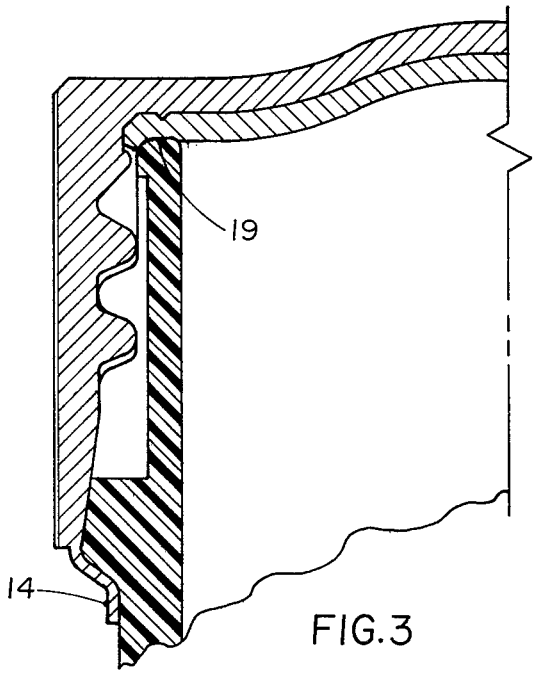
FIG. 3
0 1/2"
SCALE

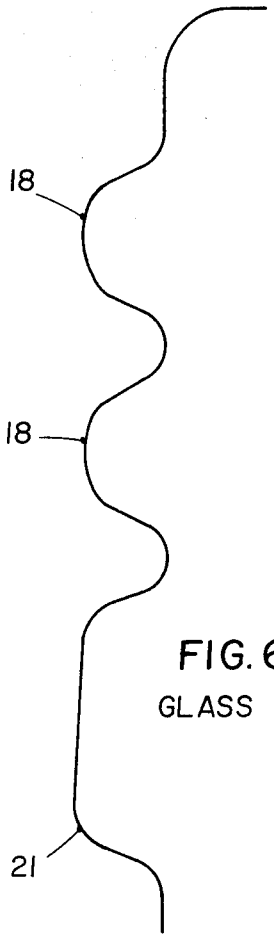
FIG. 6
GLASS 7 T.P.I.
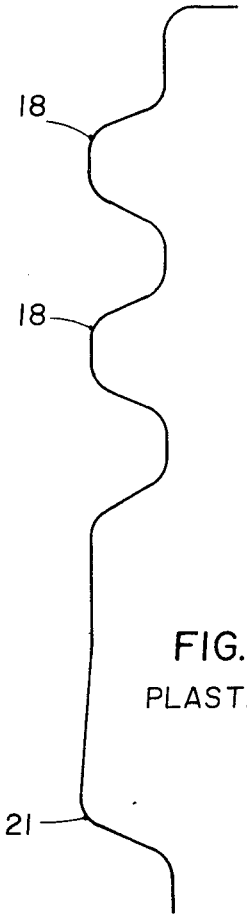
FIG. 5
PLASTIC 8 T.P.I.
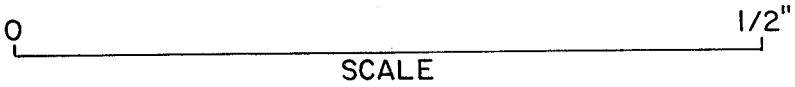
FIG. 8
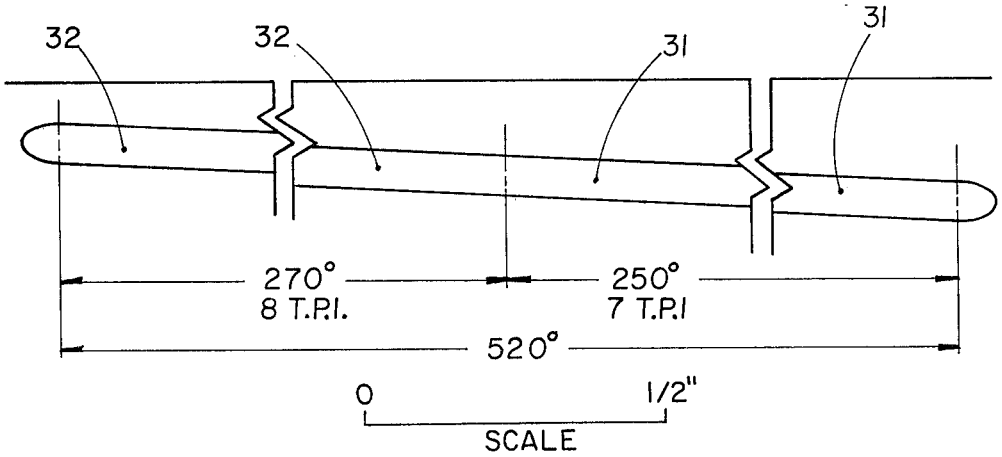

FIG. 7
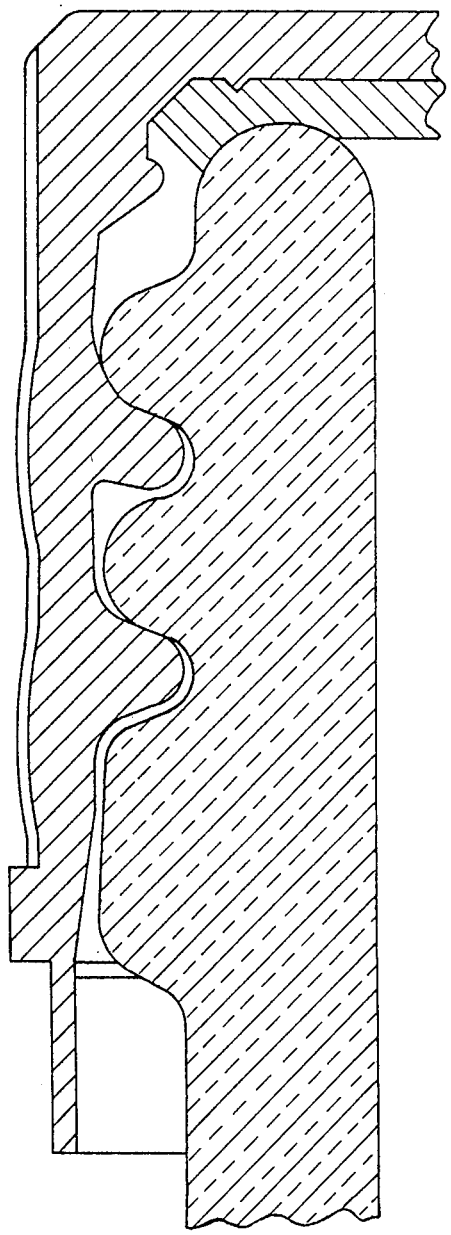
FIG. 10
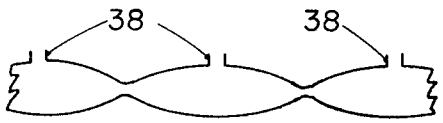
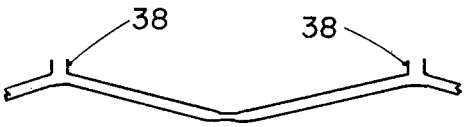
FIG. 11
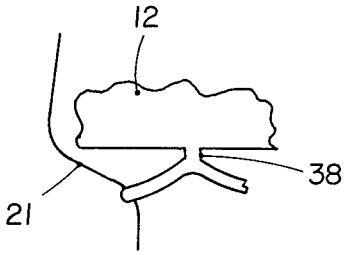
FIG. 12
0 1/2"
SCALE - FIG. 7

BOTTLE CAPS

This invention relates to molded plastic caps for bottles, particularly bottles containing carbonated beverages. Molded plastic bottle caps for use on both glass and plastic (e.g. polyethylene terephthalate) bottles for holding carbonated beverages under pressure are well known. See for instance, Modern Plastics April 1977 page 49, and Food & Drug Packaging April 1982 pages 1, 14, 24, 44 and 45.

Certain embodiments are illustrated in the accompanying drawings in which

FIG. 1 is a cross-sectional elevation of a bottle cap,

FIG. 2 is a cross-sectional elevation with parts broken away showing the bottle cap on the neck of a plastic bottle of carbonated beverage, FIG. 3 is a view like FIG. 2 after the anti-tamper skirt of the cap has been heated to shrink underneath a shoulder of the bottle and after the bottle has been allowed to warm up, causing the cap to take on a domed shape, FIG. 4 is a view similar to FIG. 1 but enlarged and with parts broken away, FIG. 5 shows the profile of a standard neck for plastic bottles for carbonated beverages, FIG. 6 is like FIG. 5 but for a standard glass bottle neck, FIG. 7 is a cross-sectional elevation, with parts broken away showing a cap, having threads corresponding to the standard plastic bottle neck, screwed onto a standard glass bottle, FIG. 8 is view, broken away, showing a modified form of cap thread as unrolled, FIG. 9 is a view like FIG. 1, but showing only the lower portion of a cap having a larger number of connectors which join the cap skirt to the sidewall, FIG. 10 is a view in elevation showing the configuration of a portion of a cap skirt of FIG. 9 after heat shrinking onto a bottle neck, FIG. 11 is a view like FIG. 10 but of a skirt having the longer spans between its connections to the main body of the cap, FIG. 12 is a view in elevation showing a portion of a cap having such longer spans on a (plastic) bottle neck after heat shrinking.

FIGS. 1–9 are drawn to the scales shown on the sheets on which those Figs. appear.

The cap shown in FIG. 1 comprises a top wall 11 and generally cylindrical side wall 12 which has an internal integral screw thread 13 for engaging the thread of the bottle neck and has, at the bottom, an integral antitamper skirt 14. The cap is preferably made by injection molding, using conventional techniques, and typically is made of a polyolefin, such as stereoregular polypropylene. The cap carries a circular gasket 16 retained against the inner face of the top wall.

In use, the cap is screwed onto the neck 17 (FIG. 2) of the filled bottle (which has an external screw thread 18 adapted to be engaged by the internal thread of the cap) so that the lip 19 at the top of the bottle neck compresses the gasket 16. Heat is applied to cause the skirt 14 to shrink underneath a shoulder 21 on the bottle neck. (Typically this is done by moving the bottles past a blast of hot air (e.g. at 500° F.) directed at the skirt while the bottles are caused to rotate about their vertical axes.) The cap cannot then be removed from the bottle without visibly deforming the skirt so that the public can readily recognize caps which have been wholly or partially removed and then replaced.

To help retain the gasket in the cap during transportation, etc., there are nubs 22 projecting inwards from the upper part of the side wall of the cap at a level just below (or at) the level of the bottom of the gasket.

The circular top wall of the cap has a fine projecting concentric ring 23 against which the gasket is pressed, and deformed, when the gasket is compressed (by contact with the mouth of bottle) when the cap is screwed onto the neck of the bottle. The cross section of this ring is preferably such that it has a relatively sharp bottom edge 24; most preferably it is V-shaped as illustrated.

The inside corner 26 at which the top and side walls meet is integrally filled, e.g., chamfered as shown, to such an extent that the outer portion of the gasket becomes compressed and deformed against the outer edge of the bottle lip 19 when the cap is screwed on (see FIGS. 2 and 3). The construction and stiffness of the cap are such that when, during storage or transportation, the pressure inside the bottle rises, the top wall of the cap is pushed upward and the corner 26 is thereby correspondingly pulled inward. This puts additional pressure on the outer portion of the gasket, (situated between the chamfer at corner 26 and the outer edge of lip 19), making for a better seal against loss of gas.

It should be noted that the capping of carbonated beverage bottles is conventionally carried out at low temperatures (e.g. 34° F.) for maximum solubility of $CO_2$. At that point the gas pressure in the bottle is relatively low (e.g. 10–15 psig or less). The pressure rises on warming. Typically capped bottles must pass a test requiring complete retention of $CO_2$ gas at 100 psig at 68° F.

Preferably the top wall of the cap is molded into a configuration which is concave upward (see FIG. 1). Then when the cap is screwed on, the force exerted at lip 19 causes this originally concave wall to straighten (e.g. to a substantially flat configuration (FIG. 2). Then the pressure resulting from release of gas (on warming, etc.) causes the cap to take on a domed shape (FIG. 3).

As will be seen in FIGS. 1 and 4, in the illustrated embodiment the gasket-retaining nubs 22 are so situated that there is room above them for the outer circumferential portion of the gasket to be retained without substantial compression thereof against the chamfer; when the cap is screwed tightly onto the bottle that outer gasket portion is pushed upward and compressed against the chamfer at corner 26. Additional compression occurs when the gas pressure causes the corner to be pulled inward, as described above.

In present commercial plastic soda bottles (made of polyethylene terephthalate, "P.E.T.") the thread at the neck of the bottle makes about 1½ turns at a pitch of 8 turns per inch while the corresponding commercial glass soda bottles similarly use about 1½ turns of a thread whose pitch is, however, 7 turns per inch. See FIGS. 5 and 6 which show the profiles at the upper portion of the necks. The standards for threaded plastic bottle necks are described in the Alcoa published specifications for neck finish no. 1716 for aluminum screw caps; those for threaded glass bottle necks are described in the Glass packaging Institute specifications no. 1650 for 28 mm. thread finish for aluminum screw cap. As can be seen in FIGS. 5 and 6 the thread of the glass bottle has a lower pitch than that of the plastic bottle, and it starts at a lower level (with respect to the top of the bottle neck) than the thread of the plastic bottle.

The cap of this invention may have a 7 t.p.i. thread, for use on a glass bottle, or an 8 t.p.i. thread, for use on a plastic bottle.

Surprisingly it is found that the cap for the plastic bottle, with a cap thread pitch of 8 t.p.i. can be used successfully on the glass bottles without leaking under pressure (e.g. an internal pressure of 100 psig or even higher, such as 175 psig). When the 8 t.p.i. cap is screwed onto the glass bottle it is found that the cap thread becomes deformed by the glass thread as illustrated in FIG. 7 (owing to its location at the upper portion of the cap, the thread is restrained so that it does not slip over the glass thread). Because of the differences in dimensions the cap only makes about ¾ turn before the lip of the glass bottle neck engages the gasket 16 and presses it against the top wall of the cap; nevertheless the cap holds firmly on the glass bottle without leaking and meets the standard of withstanding an internal pressure of 175 psig without blowing off.

In another embodiment of a cap suitable for use with both glass and plastic bottles, the lower reach 31 (FIG. 8) of the cap thread has a pitch of about 7 tpi while the upper reach 32 of the same thread has a pitch of about 8 tpi. The lower reach 31 extends, for instance, for about 250° of arc and is sufficient to be effective in itself for tightly retaining the cap on the neck of the glass bottle (in which, as mentioned above, the thread start position is lower). The length of the whole thread is, for instance, about 520° which is about the same as the arcuate length of the standard thread of the plastic bottle. When this cap is screwed onto the neck of the standard plastic bottle there is enough play or clearance between the bottle threads and the cap threads to enable the 7 tpi portion of the cap thread to screw relatively freely onto the bottle before the 8 tpi thread portion comes into contact with the bottle threads.

In use, during unscrewing the cap from the bottle, the partially unscrewed cap is only loosely retained by the threads and there is sometimes a danger that the cap will be forcibly blown off the bottle. To avoid this there is preferably a pressure-relieving vent 34 (FIG. 1) intersecting the threads of the caps and corresponding vent passages 36 (FIG. 2) intersecting the threads of the bottle.

Another aspect of this invention relates to anti-tamper skirt 14, which is joined to the main body of the cap by a number of circumferentially spaced integral connectors 38. It has been found that when the number of such connectors is five or less instead of eight or ten, so that each section of the skirt between connectors extends for at least about 65° (or a circumferential distance of at least about 0.66 inch) a much better effect is obtained on heat shrinking. The resulting heat shrunk skirt has a neater and more pleasing appearance, the shrunk skirt sections are of more uniform thickness and the tamper-indicating is more clearly noticeable. To insure that the skirts are maintained in their generally circular as-molded condition during conventional handling prior to actual application to the bottle neck, it is desirable that there be more than two connectors 38; caps having five connectors are preferred. Most preferably the connectors are spaced about equally around the circumference. FIGS. 10 and 11 compare the appearance of the heat shrunk skirt when the number of connectors 38 is 10 (FIGS. 9, 10) and 5 (FIGS. 1, 11 and 12.)

The caps illustrated herein were made by conventional injection molding, with the molten plastic being fed through a gate at a point on the side wall 12 about 0.1 inch below the top wall; the molten plastic flowed through the narrow passages (of about 0.032 inch diameter) for the connectors 38 and into the skirt portion of the mold cavity. As will be seen in FIG. 10 the heat shrunk skirt having 10 connectors has a large variation in skirt width, being very narrow at points about halfway between connectors. This indicates that during the injection molding operation the meeting streams of molten plastic from adjacent connector passages may not have knitted together as fully as possible thereby creating relatively weaker zones which are not apparent on visual inspection of the unshrunk molded cap. Nevertheless, as shown in FIGS. 11 and 12, a better effect was produced, under otherwise substantially identical conditions, when the number of connector passages was halved and the length of plastic travel through the skirt portion was correspondingly doubled.

The distances between the top of the bottle neck and the shoulder 21 are about the same for the standard plastic and glass bottle necks (see FIGS. 5 and 6). Caps having the previously described thread constructions, which are suitable on both those types of necks, are also suitable for both necks with respect to the antitamper skirt.

When the cap is first unscrewed from the bottle the heat shrunk skirt breaks at one or more points and one or more of the connectors 38 may also break. Preferably the mold design is such that one of the plurality of connectors 38 is stronger than the other connectors (e.g. that connector may be of greater cross section) so as to assure that the broken skirt remains attached to the main body of the cap by that stronger connector. In the illustrated embodiment (see FIG. 4 for instance) the skirt is a thin band having a height well above 5 times its thickness. Between connectors this band has a generous chamfer or taper at the undercut; this facilitates removal of the cap from the mold, as is well known in the art of mold design; that is, when, during the removal operation, the molded plastic piece is moved axially relative to the mold, the skirt is free to collapse inward slightly to allow the undercut to ride free of the mold recess. The outside of the side wall 12 of the cap preferably has a conventional rough outer surface so that the cap may be grasped and turned manually more easily; thus it may have fine vertical fluting as indicated in FIGS. 1–4.

A preferred polypropylene for use in this invention is a propylene copolymer such as Soltex 5421 having a melt index of about 8 and having the following typical properties: tensile strength, yield 4580 psi; tensile strength, break 2800 psi; elongation yield 10%; elongation break 240%; flexural modulus of elasticity 185,000 psi; notched izod impact @ 23° C. 0.6 ft lbs/in.; unnotched izod impact @ 23° C. more than 25 ft lbs/in.; defelection temperature @ 66 psi 243° F.; hardness 69 Shore D. The gasket may be of conventional type; thus it may be made by the usual techniques (e.g. extrusion of a ribbon calendering the ribbon and then die cutting gaskets therefrom). A preferred plastic for the gasket is low density polyethylene mixed with modifying agents, such as ethylene-vinyl acetate copolymer (e.g. in amount of about 18% of the mixture) and wax (e.g. about 1% of the mixture). Preferably the gasket is not porous, blown or foamed; typically it is about 0.20 to 0.35 (e.g. 0.28) inch thick and has a hardness of about 40 Shore A.

The caps of this invention preferably weigh less than 3.5 grams, more preferably less than 3.0 grams (e.g. 2.8 grams) and their wall thickness is preferably less than 0.060 inch, e.g. 0.050 inch. As indicated, filled bottles capped therewith are capable of withstanding the tests conventionally used by soft drink bottlers, such as retention of pressure and resistance to blowoff after being screwed onto the bottle necks using the torques conventionally employed, e.g. 14–18 inch pounds.

As shown in FIG. 1, the cap has an internal diameter of about 1.1 inch.

It is understood that the foregoing detailed description is given merely by way of illustration and that variations may be made therein without departing from the spirit of the invention.

I claim:

1. A capped filled glass bottle of carbonated beverage under pressure said bottle having a standard glass bottle neck having an external thread whose pitch is 7 turns per inch, capped with a plastic screw cap screwed onto said neck, said cap comprising a top wall, an annular sidewall extending down from said top wall and having an inwardly extending thread for cooperation with said neck thread, said cap thread having a pitch of 8 turns per inch, said sidewall and said top wall meeting at a corner, a gasket held below said top wall and compressed against said top wall by engagement with the top of said bottle neck, the upper reach of said 8 t.p.i. cap thread being downwardly deformed by the upper reach of said 7 t.p.i. neck thread, said capped bottle retaining carbon dioxide therein at an internal pressure of 100 psig at a temperature of 68° F., said cap, prior to screwing onto said glass bottle neck, also fitting onto a standard plastic carbonated beverage bottle neck having an external thread whose pitch is 8 t.p.i. and being constructed to effectively seal such a filled plastic bottle at said pressure conditions, said bottle neck having an outwardly extending shoulder beneath said thread, said cap having an anti-tamper skirt in interfering relationship with said shoulder.

2. A plastic bottle cap for a bottle of carbonated beverage under pressure said bottle having a neck carrying an outwardly extending thread, said cap comprising:

a top wall, an annular sidewall extending down from said top wall and having an inwardly extending thread for cooperation with said neck thread, said sidewall and said top wall meeting at a corner, a gasket held below said top wall in a position to be compressed against said top wall by engagement with the top of said bottle when the cap is screwed onto said neck, the improvement wherein said cap thread has a lower reach in which the thread pitch is about 7 turns per inch and an upper reach in which the thread pitch is about 8 turns per inch, the lengths of said reaches and the cap dimensions being such that said cap fits securely on both a standard threaded glass carbonated beverage bottle neck having a thread pitch of 7 t.p.i. and a standard plastic carbonated beverage bottle neck having about 1½ thread turns with a thread pitch of 8 t.p.i.

3. A capped filled glass bottle containing carbonated beverage under pressure, said bottle having a standard threaded glass carbonated beverage bottle neck having a thread pitch of 7 t.p.i., said bottle being capped with the cap of claim 2 screwed tightly onto said neck so that said gasket is compressed against the top of said neck.

4. A capped filled plastic bottle containing carbonated beverage under pressure, said bottle having a standard threaded plastic carbonated beverage bottle neck having about 1½ thread turns with a thread pitch of 8 t.p.i., said bottle being capped with the cap of claim 2 screwed tightly onto said neck so that said gasket is compressed against the top of said neck.

5. A capped bottle as in claim 3 in which the plastic of said cap is stereoregular polypropylene and said cap has an internal diameter of about 1.1 inch.

6. A capped bottle as in claim 4 in which the plastic of said cap is stereoregular polypropylene and said cap has an internal diameter of about 1.1 inch.

7. A cap as in claim 2 made of stereoregular polypropylene and having an internal diameter of about 1.1 inch.

8. A capped bottle as in claim 1 in which the plastic of said cap is stereoregular polypropylene, said cap has an internal diameter of about 1.1 inch and said cap is screwed about ¾ turn onto said neck.

* * * * *